US010071899B2

(12) United States Patent
Mastro et al.

(10) Patent No.: US 10,071,899 B2
(45) Date of Patent: Sep. 11, 2018

(54) APPARATUSES, SYSTEMS, AND METHODS FOR DISPENSING CONDIMENTS

(71) Applicant: Cornelius, Inc., St. Paul, MN (US)

(72) Inventors: Brian Mastro, Des Plaines, IL (US); Elizabeth Bertness, Batavia, IL (US); Vincenzo DiFatta, Wood Dale, IL (US); Christopher J. Knight, Lisle, IL (US); Michal Augustyniak, Bloomingdale, IL (US); Basavraj Sankhgond, State-Maharashtra (IN)

(73) Assignee: Cornelius, Inc., Osseo, MN (US)

( * ) Notice: Subject to any disclaimer, the term of this patent is extended or adjusted under 35 U.S.C. 154(b) by 92 days.

(21) Appl. No.: 15/133,809

(22) Filed: Apr. 20, 2016

(65) Prior Publication Data

US 2016/0332176 A1 Nov. 17, 2016

Related U.S. Application Data

(60) Provisional application No. 62/162,224, filed on May 15, 2015.

(51) Int. Cl.

| | |
|---|---|
| ***B05B 7/04*** | (2006.01) |
| ***B67D 1/00*** | (2006.01) |
| ***B67D 1/08*** | (2006.01) |

(52) U.S. Cl.

CPC ..... *B67D 1/0044* (2013.01); *B67D 1/0083* (2013.01); *B67D 1/0888* (2013.01)

(58) Field of Classification Search

CPC .. B67D 1/0044; B67D 1/0051; B67D 1/0052; B67D 1/0083

See application file for complete search history.

(56) References Cited

U.S. PATENT DOCUMENTS 2,537,119 A * 1/1951 Bauerlein ..... B67D 1/0051 137/594
3,460,717 A * 8/1969 Thomas ..... A23G 9/282 222/129.1

(Continued)

OTHER PUBLICATIONS

International Search Report and Written Opinion, PCT/US2016/028759, dated Jul. 27, 2016.

*Primary Examiner* — J. Casimer Jacyna
(74) *Attorney, Agent, or Firm* — Andrus Intellectual Property Law, LLP

(57) ABSTRACT

Apparatuses, systems, and methods are for dispensing condiments, including a base condiment together with and at least one additive. In some examples, a dispenser apparatus comprises a dispenser body having an upstream inlet that is configured to receive the base condiment and a downstream outlet that is configured to dispense the base condiment together with the additive(s). An additive body is configured to supply the additive(s) into the dispenser body as the base condiment is conveyed from the upstream inlet to the downstream outlet so that the base condiment and the additive(s) are concurrently dispensed via the downstream outlet. The systems and methods can operatively include arrangements for selecting a base condiment; selecting one or more additives from a plurality of additives; and supplying the base condiment and the additive(s) to a dispenser apparatus that dispenses the base condiment and additive(s) together.

19 Claims, 10 Drawing Sheets

(56) References Cited

U.S. PATENT DOCUMENTS

| | | | | |
|---|---|---|---|---|
| 4,708,266 | A * | 11/1987 | Rudick | B67D 1/0036 222/105 |
| 4,753,370 | A * | 6/1988 | Rudick | B67D 1/0051 222/105 |
| 5,033,651 | A * | 7/1991 | Whigham | B67D 1/0051 222/1 |
| 5,102,016 | A | 4/1992 | Ball et al. | |
| 5,203,474 | A * | 4/1993 | Haynes | B67D 1/0044 222/129.1 |
| 5,366,117 | A | 11/1994 | Mesenbring et al. | |
| 5,435,466 | A | 7/1995 | Du | |
| 5,549,222 | A | 8/1996 | Schroeder | |
| 6,189,736 | B1 | 2/2001 | Phallen et al. | |
| 6,227,420 | B1 | 5/2001 | Jepson | |
| 6,357,632 | B1 | 3/2002 | Salmela | |
| 6,390,662 | B1 * | 5/2002 | Henry | A21C 15/005 118/14 |
| 7,159,743 | B2 | 1/2007 | Brandt et al. | |
| 7,445,133 | B2 | 11/2008 | Ludovissie et al. | |
| 7,487,887 | B2 * | 2/2009 | Ziesel | B67D 1/0051 222/129.1 |
| 7,878,370 | B2 | 2/2011 | Sevcik et al. | |
| 8,113,386 | B2 * | 2/2012 | Herrick | A23C 9/133 141/105 |
| 2008/0041876 | A1 * | 2/2008 | Frank | A23G 9/045 222/1 |
| 2008/0083780 | A1 * | 4/2008 | Romanyszyn | B67D 1/0025 222/129.1 |
| 2017/0190554 | A1 * | 7/2017 | Dahlberg | B67D 1/0021 |

* cited by examiner

APPARATUSES, SYSTEMS, AND METHODS FOR DISPENSING CONDIMENTS

CROSS-REFERENCE TO RELATED APPLICATION

The present application claims priority to and the benefit of U.S. Provisional Patent Application No. 62/162,224, filed on May 15, 2015, which is hereby incorporated herein by reference.

FIELD

The present disclosure relates to apparatuses, systems, and methods for dispensing condiments, specifically condiments having at least one base condiment together with at least one additive.

BACKGROUND

The following patents are incorporated herein by reference in their entirety:

U.S. Pat. No. 6,357,632 discloses a condiment dispensing apparatus for dispensing a condiment by controlling condiment pump activation and opening and closing of the dispensing outlet without requiring electronic circuitry. The apparatus employs pneumatic devices to open and close the dispensing outlet and to drive the condiment pump and a mechanical mechanism to synchronize pump activation and opening and closing of the dispensing outlet.

U.S. Pat. No. 6,227,420 discloses a condiment drawback valve for a condiment dispensing system, which compensates for run-on from a depressurized pump during deactivation and draws back any hanging condiment left in the dispensing outlet of the system, thereby eliminating drips after the pump is stopped.

U.S. Pat. No. 6,189,736 discloses a condiment dispensing apparatus for dispensing condiments from a bag-in-box-type container. The dispenser includes a high durometer compressible elastomeric liquid flow tube, an infeed and outfeed thereto and therefrom, and a movable anvil with a round surface to compress the tube. An opposed stationary anvil holds the tube for compression by the movable anvil. The tube is held between the anvils in a slightly compressed state even when the anvil is retracted.

U.S. Pat. No. 5,435,466 discloses a condiment dispensing system for delivering a measured quantity of condiment at a desired flow rate. The system includes a pump which is fluidly connected to a condiment source and a dispensing apparatus. A valve assembly is connected to a pressurized fluid source and to the pump, whereby actuation of the valve assembly causes a measured quantity of the condiment to be dispensed from an outlet nozzle.

U.S. Pat. No. 5,366,117 discloses a system for selectively dispensing condiments for items of food. The system includes a plurality of condiment containers, a dispenser head having a plurality of input passages, an outlet nozzle, and valves for controlling fluid flow from each of the input passages to the outlet nozzle. The system further includes a plurality of fluid flow lines, with a line connecting each condiment container to a corresponding dispenser head input passage, and a fluid pump in each of the fluid flow lines whereby an operator can dispense selected condiments from the nozzle onto a food item.

SUMMARY

This Summary is provided to introduce a selection of concepts that are further described herein in the Detailed Description. This Summary is not intended to identify key or central features from the claimed subject matter, nor is it intended to be used as an aid in limiting the scope of the claimed subject matter.

Apparatuses, systems, and methods are provided for dispensing condiments, including at least one base condiment together with and at least one additive. In some examples, a dispenser apparatus comprises a dispenser body having an upstream inlet that is configured to receive the base condiment and a downstream outlet that is configured to dispense the base condiment together with the additive. An additive body is configured to supply the additive into the dispenser body as the base condiment is conveyed from the upstream inlet to the downstream outlet such that the base condiment and the at least one additive are concurrently dispensed via the downstream outlet. In certain non-limiting examples, the additive body includes an additive injector that is configured to inject the at least one additive into the base condiment as the base condiment is conveyed from the upstream inlet to the downstream outlet. Corresponding systems and methods can operatively include arrangements for selecting a base condiment; selecting one or more additives from a plurality of additives; and supplying the base condiment(s) and the additive(s) to a dispenser apparatus that concurrently dispenses the base condiment(s) and additive(s) together.

BRIEF DESCRIPTION OF THE DRAWINGS

Examples of apparatuses, systems, methods for dispensing condiments are described with reference to the following drawing FIGURES. The same numbers are used throughout the FIGURES to reference like features and components.

DETAILED DESCRIPTION OF THE DRAWINGS

Figure 1:
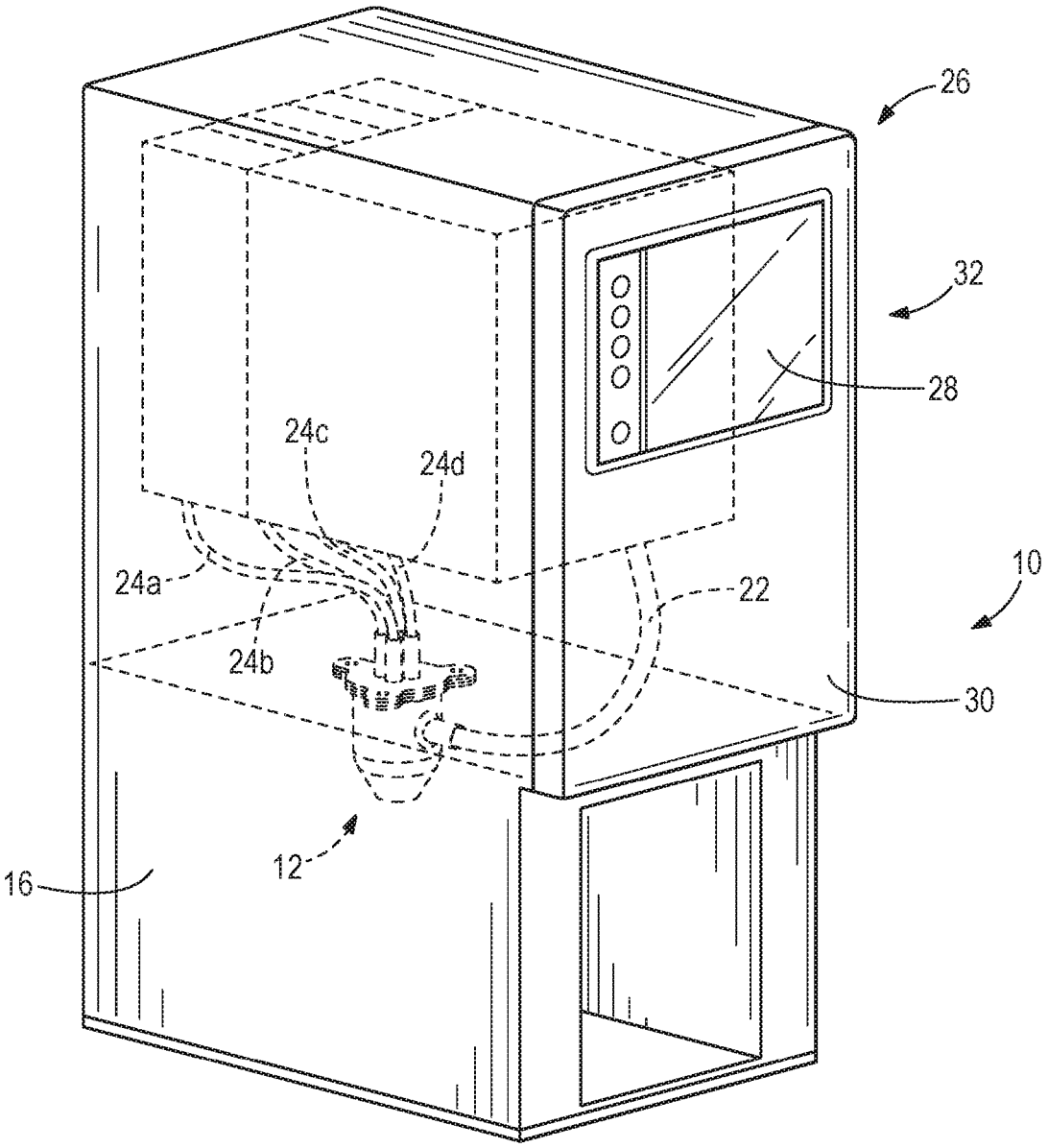
FIG. 1 is a perspective view of an apparatus and system for dispensing condiments according to the present disclosure.
Figure 2:
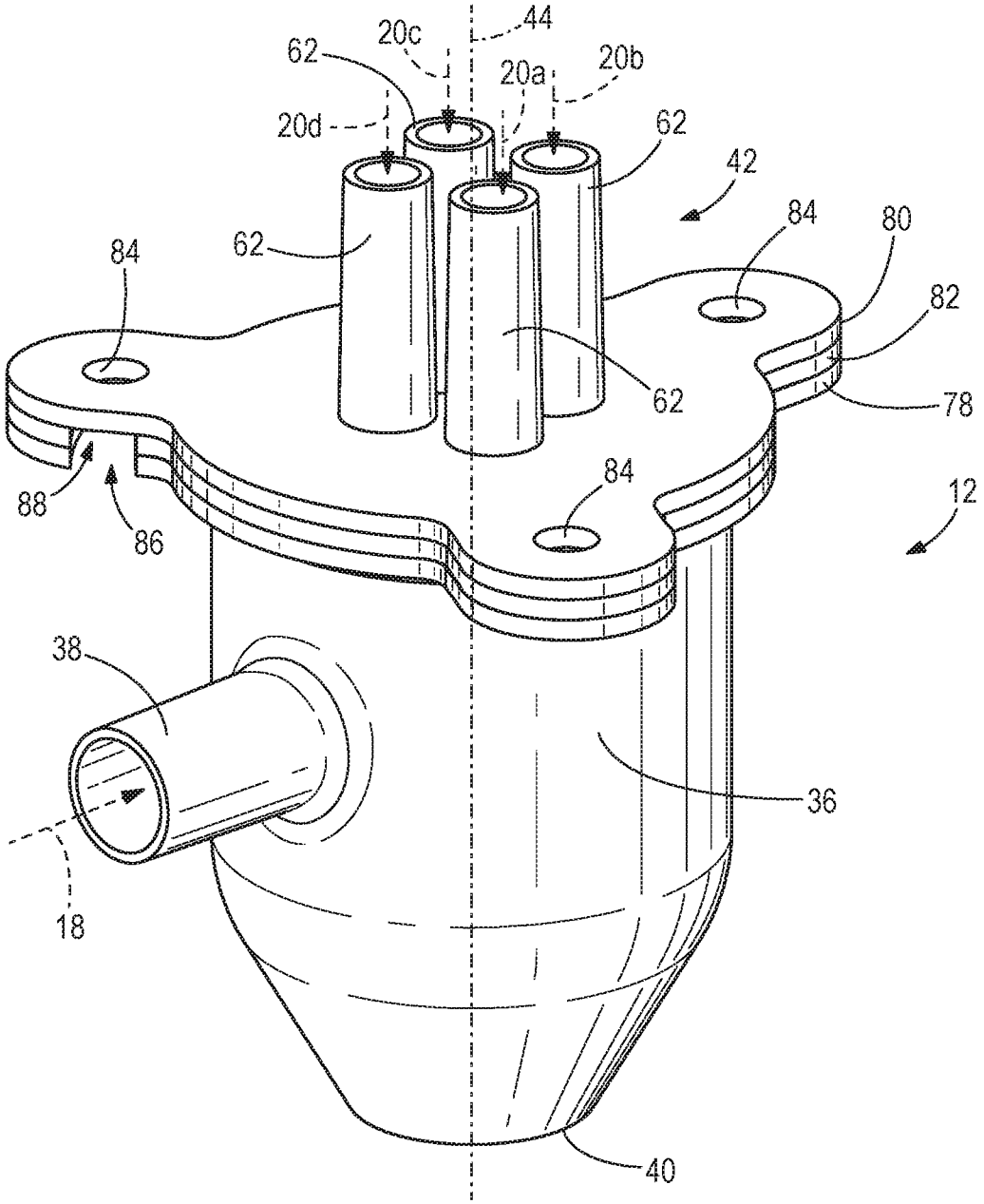
FIG. 2 is a perspective view of one exemplary dispenser apparatus.
Figure 3:
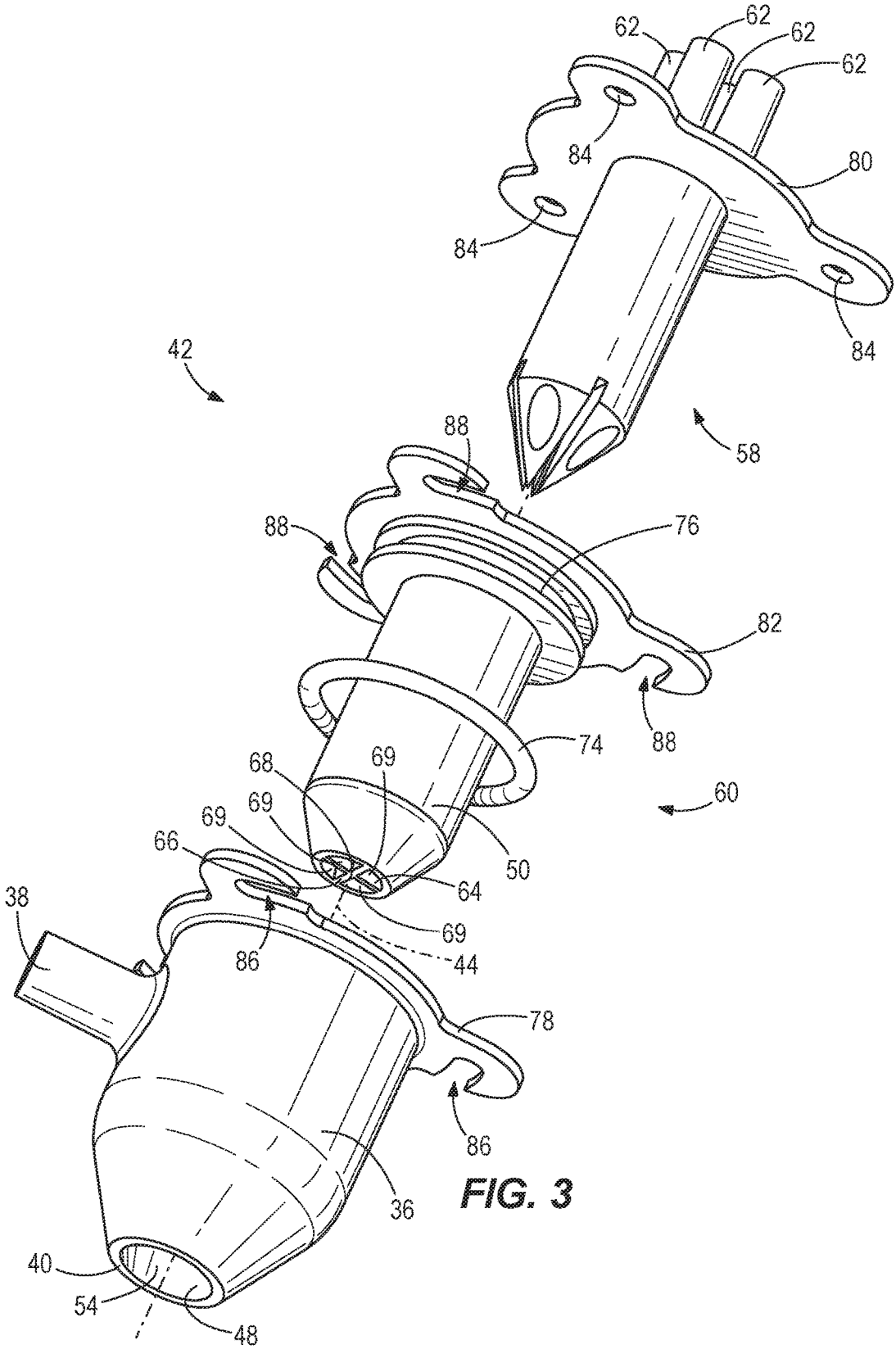
FIG. 3 is an exploded view of the dispenser apparatus shown in FIG. 2.

In the present disclosure, certain terms are used for brevity, clearness and understanding. No unnecessary limitations are to be implied therefrom beyond the requirement of the prior art because such terms are used for descriptive purposes only and are intended to be broadly construed. The different apparatuses, systems and methods described herein may be used alone or in combination with other apparatuses, systems and methods. Various equivalents, alternatives and modifications are possible within the scope of the appended claims.

The present disclosure is described herein using several definitions, as set forth below and throughout the application. Unless otherwise specified or indicated by context, the terms "a", "an", and "the" mean "one or more." For example, "a compound" should be interpreted to mean "one or more compounds."

As used herein, "about," "approximately," "substantially," and "significantly" will be understood by persons of ordinary skill in the art and will vary to some extent on the context in which they are used. If there are uses of these terms which are not clear to persons of ordinary skill in the art given the context in which they are used, "about" and "approximately" will mean plus or minus ≤10% of the particular term and "substantially" and "significantly" will mean plus or minus >10% of the particular term.

As used herein, the terms "include" and "including" have the same meaning as the terms "comprise" and "comprising" in that these latter terms are "open" transitional terms that do not limit claims only to the recited elements succeeding these transitional terms. The term "consisting of," while encompassed by the term "comprising," should be interpreted as a "closed" transitional term that limits claims only to the recited elements succeeding this transitional term. The term "consisting essentially of," while encompassed by the term "comprising," should be interpreted as a "partially closed" transitional term which permits additional elements succeeding this transitional term, but only if those additional elements do not materially affect the basic and novel characteristics of the claim.

During research and development, the present inventors have determined that it is desirable to provide apparatuses, systems, and methods for efficiently and effectively dispensing condiments, including one or more base condiments together with one or more additives. More particularly, the present inventors have found that it is desirable to provide apparatuses, systems and methods for concurrently dispensing the base condiment(s) together with the additive(s) in a repeatable manner that produces a consistent output that is visually appealing to the consumer.

Through research and experimentation, the present inventors conceived of the concepts in the present disclosure, which include apparatuses, systems, and methods for dispensing condiments, wherein base condiment(s) are dispensed together with the additive(s). In certain examples, the additive(s) are selected by the consumer and then concurrently dispensed with, including but not limited to, for example, injected into, the base condiment(s) prior to or during dispense. In certain non-limiting examples, the apparatuses, systems, and methods are operable to dispense the base condiment(s) together with the additive(s), for example in a tubular shape wherein a visually singular tube of condiment (e.g. a tube having a singular, consistent appearance) is dispensed. Various other apparatuses, systems, methods will become apparent from the following non-limiting description and drawings.

FIGS. 1-12 depict examples of apparatuses, systems and methods for dispensing condiments. FIG. 1 is a perspective view of an exemplary system 10. FIGS. 2-6 depict a first example of a dispenser apparatus 12 for dispensing at least one base condiment 18 and at least one additive 20. FIGS. 7-11 depict a second example of a dispenser apparatus 14 for dispensing at least one base condiment 18 and at least one additive 20. The dispenser apparatuses 12, 14 are similar in many respects and are also different in several respects. Like reference numbers are used to refer to the same or similar features. The exemplary dispenser apparatuses 12, 14 are for example only and are not intended to be limiting on the subject matter set forth in the following claims.

Referring to FIG. 1, a dispenser housing 16 is shown in solid line format. Certain aspects of the noted system 10 are shown in dashed line format, including a supply of base condiment 18 and supplies of four different types of additives 20*a*, 20*b*, 20*c*, 20*d* (see FIG. 2). The types of base condiment 18 can vary and for example can include ketchup, mustard, mayonnaise, and/or any other type of condiment or sauce. The types of additives 20*a*-20*d* can vary and for example can include mayonnaise, jalapeno sauce, horseradish sauce, and/or any other type of flavoring or sauce. The number of supplies of base condiment 18 and the number of supplies of additives 20*a*-20*d* is merely exemplary and can vary from that which is shown. In other examples, the system 10 can include more than one type of supply of base condiment 18 and more than or less than four types of supplies of additives 20*a*-20*d*.

The supply of base condiment 18 and the supplies of additives 20*a*-20*d* are connected to the dispenser apparatus 12 via supply lines 22 and 24*a*-24*d*, respectively. In the illustrated example, the supply of base condiment 18, supplies of additives 20*a*-20*d*, associated supply lines 22, 24*a*-24*d*, and dispenser apparatus 12 are all contained within the dispenser housing 16. However, in other examples these items can be remotely located from each other, for example wherein the supply of base condiment 18 and/or supplies of additives 20*a*-20*d* are located in a supply room, located remotely from the location of the dispenser apparatus 12.

In certain examples, a conventional refrigeration system (not shown) is associated with the dispenser housing 16 and configured to maintain the temperature within the dispenser housing 16 within a range suitable to prevent spoilage of the base condiment(s) 18 and/or additive(s) 20. Such refrigeration systems are well known in the art and as such are not further described herein.

The system 10 includes an operator input device 26 and a computer controller 32. In this example, the operator input device 26 includes a touch screen 28 located on the dispenser housing 16, in particular on an access door 30 of the dispenser housing 16. The type and configuration of operator input device 26 and controller 32 can vary from that which is shown. The operator input device 26 can include one or more conventional input devices for inputting operator selections of base condiments 18 and/or additives 20 to the controller 32. Exemplary operator input devices include touch screens, mechanical buttons, mechanical switches, voice command receivers, tactile command receivers, gesture sensing devices, and/or remove controllers such as personal digital assistant(s) (PDAs), handheld(s), laptop computer(s), and/or the like.

Figure 12:
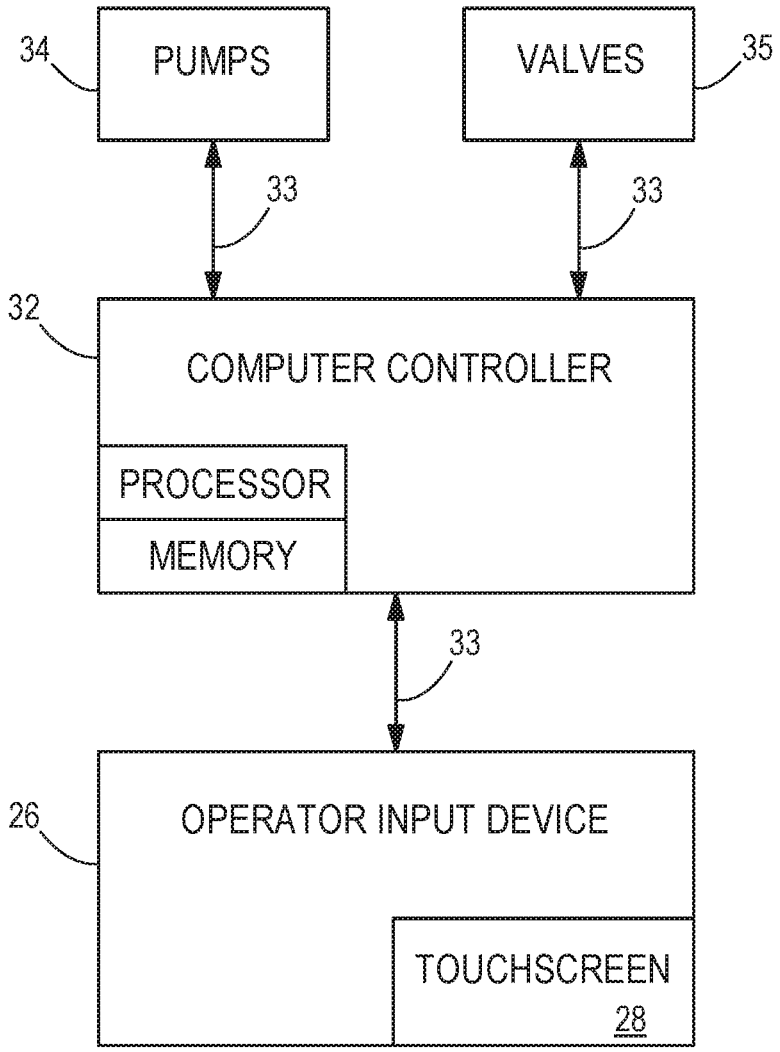
FIG. 12 is a system diagram.

Referring to FIG. 12, the controller 32 is configured to control the operator input device 26, the supply of base condiment 18, the supplies of additives 20, and any pumps 34, valves 35 and/or other devices associated therewith for supplying selected base condiment(s) 18 and additive(s) 20 to the dispenser apparatus 12 in accordance with inputs to the operator input device 26. The controller 32 can be located in the dispenser housing 16 and/or can be located remotely from the dispenser housing 16. In some examples, the controller 32 can be configured to communicate via the Internet or any other suitable communication link. Although FIG. 12 shows one controller 32, there can be more than one controller 32. Portions of the methods described herein can be carried out by a single controller or by several separate controllers. Each controller can have one or more control sections or control units. In some examples, the controller 32 can include a computing system that includes a processing system, storage system, software, and input/output (I/O) interfaces (e.g. operator input device 26) for communicating with devices described herein and/or with other devices. The processing system can load and execute software from the storage system. The controller 32 may include one or many application modules and one or more processors, which may be communicatively connected. The processing system may comprise a microprocessor and other circuitry that retrieves and executes software from the storage system. Non-limiting examples of the processing system include general purpose central processing units, applications specific processors, and logic devices. The storage system can comprise any storage media readable by the processing system and capable of storing software. The storage system can include volatile and non-volatile, removable and non-removable media implemented in any method or technology for storage of information, such as computer readable instructions, data structures, program modules, or other data. The storage system can be implemented as a single storage device or across multiple storage devices or sub-systems. The storage system can further include additional elements, such as a controller capable of communicating with the processing system. Non-limiting examples of storage media include random access memory, read only memory, magnetic discs, optical discs, flash memory, virtual memory, and non-virtual memory, magnetic sets, magnetic tape, magnetic disc storage or other magnetic storage devices, or any other medium which can be used to store the desired information and that may be accessed by an instruction execution system. The storage media can be a non-transitory or a transitory storage media.

In this example, the controller 32 communicates with one or more components of the system 10 via one or more communication links 33, which can be a wired or wireless links. The controller 32 is capable of monitoring and/or controlling one or more operational characteristics of the system and its various subsystems by sending and receiving control signals via the communication links 33. It should be noted that the extent of connections of the communication link 33 shown herein is for schematic purposes only, and the communication links 33 in fact provides communication between the controller 32 and each of the devices and various subsystems described herein, although not every connection is shown in the drawing for purposes of clarity.

As described further herein below, the dispenser apparatuses 12, 14 are configured to dispense the base condiment(s) 18 and additive(s) 20 together. Dispenser apparatus 12 is described with reference to FIGS. 2-6 and dispenser apparatus 14 is described with reference to FIGS. 7-11.

Referring first to FIGS. 2-6, the dispenser apparatus 12 includes a dispenser body 36 having an upstream inlet 38 that is configured to receive the base condiment 18 from the supply of base condiment 18 via the supply line 22. Although not illustrated, it is also possible for the dispenser apparatus 12 to have more than one upstream inlet 38 for receiving more than one base condiment 18 from more than one respective supply of base condiment 18. The dispenser body 36 has a downstream outlet 40 that is configured to dispense the base condiment 18 together with at least one additive 20. An additive body, which in this example is an additive injector 42 is configured to inject the additive(s) 20 into the base condiment 18 as the base condiment 18 is conveyed from the upstream inlet 38 to the downstream outlet 40. The additive injector 42 is configured to supply at least one additive 20 into the dispensing body as the base condiment 18 is conveyed from the upstream inlet 38 to the downstream outlet 40 such that the base condiment(s) 18 and the additive(s) 20 are concurrently dispensed. The type and configuration of the additive body can vary from that which is shown and does not have to include the illustrated additive injector. In other examples, the additive body can be configured to supply the additive(s) 20 along side of the base condiment(s) such that the base condiment(s) and additive(s) are concurrently dispensed along side each other (i.e. not injected into one or the other). The number of base condiments (18) and additive(s) 20 can vary from that which is shown and described.

In the example shown in FIGS. 2-6, the downstream outlet 40 extends along an outlet axis 44. The additive injector 42 extends parallel to the outlet axis 44, and the upstream inlet 38 extends transversely to the outlet axis 44. The dispenser body 36 defines a chamber 46 and the additive injector 42 is disposed in the chamber 46. The dispenser body 36 has an inner peripheral surface 48. The additive injector 42 has an outer peripheral surface 50 that is spaced apart from the inner peripheral surface 48. A base condiment passage 52 is defined between the inner peripheral surface 48 of the dispenser body 36 and the outer peripheral surface 50 of the additive injector 42. The inner peripheral surface 48 of the dispenser body 36 is configured to deflect the base condiment 18 radially inwardly towards the additive injector 42. More particularly, the inner peripheral surface 48 of the dispenser body 36 has a lower portion 54 that is funnel-shaped for deflecting the base condiment 18 radially inwardly towards the outlet axis 44 as the base condiment 18 is conveyed from the upstream inlet 38 to the downstream outlet 40. This is shown by dashed-line formatted arrows in FIG. 6. The base condiment 18 enters the chamber 46 via the upstream inlet 38 and circumscribes the outer periphery of the additive injector 42 via the base condiment passage 52. The base condiment 18 feeds downwardly in the base condiment passage 52 as shown by the dashed-line format arrows, towards the downstream outlet 40. The funnel-shape of the lower portion 54 of the inner peripheral surface 48 funnels or radially inwardly directs the base condiment 18 towards the additive injector 42 and towards the downstream outlet 40.

The configuration of the additive injector 42 can vary from that which is shown. In the illustrated example, the additive injector 42 includes an upstream injector body 58 and a downstream injector body 60. The upstream injector body 58 is nested in the downstream injector body 60. The downstream injector body 60 is nested in the dispenser body 36. The upstream injector body 58 forms a plurality of injector ports 62. The downstream injector body 60 defines an injector outlet 64 that is configured to receive the additive(s) 20 from the injector port(s) 62 and discharge the additive(s) 20 to the downstream outlet 40. In examples wherein more than one additive 20 are dispensed, the plurality of injector ports 62 each supplies a particular additive 20 and the injector outlet 64 discharges all the different additives 20. Optionally, a separator 66 is located at the injector outlet 64 for maintaining some amount of separation of the respective additives 20 as the additive(s) 20 are discharged via the injector outlet 64. The configuration of the separator 66 can vary from which is shown. In the illustrated example, the separator 66 includes a grate 68 that extends across the injector outlet 64. Each aperture 69 defined by the grate 68 is aligned with a respective injector port 62 in the plurality of injector ports 62 such that each respective additive 20 remains substantially isolated from other additives 20 in the plurality as it is dispensed via the injector outlet 64.

Figure 6:
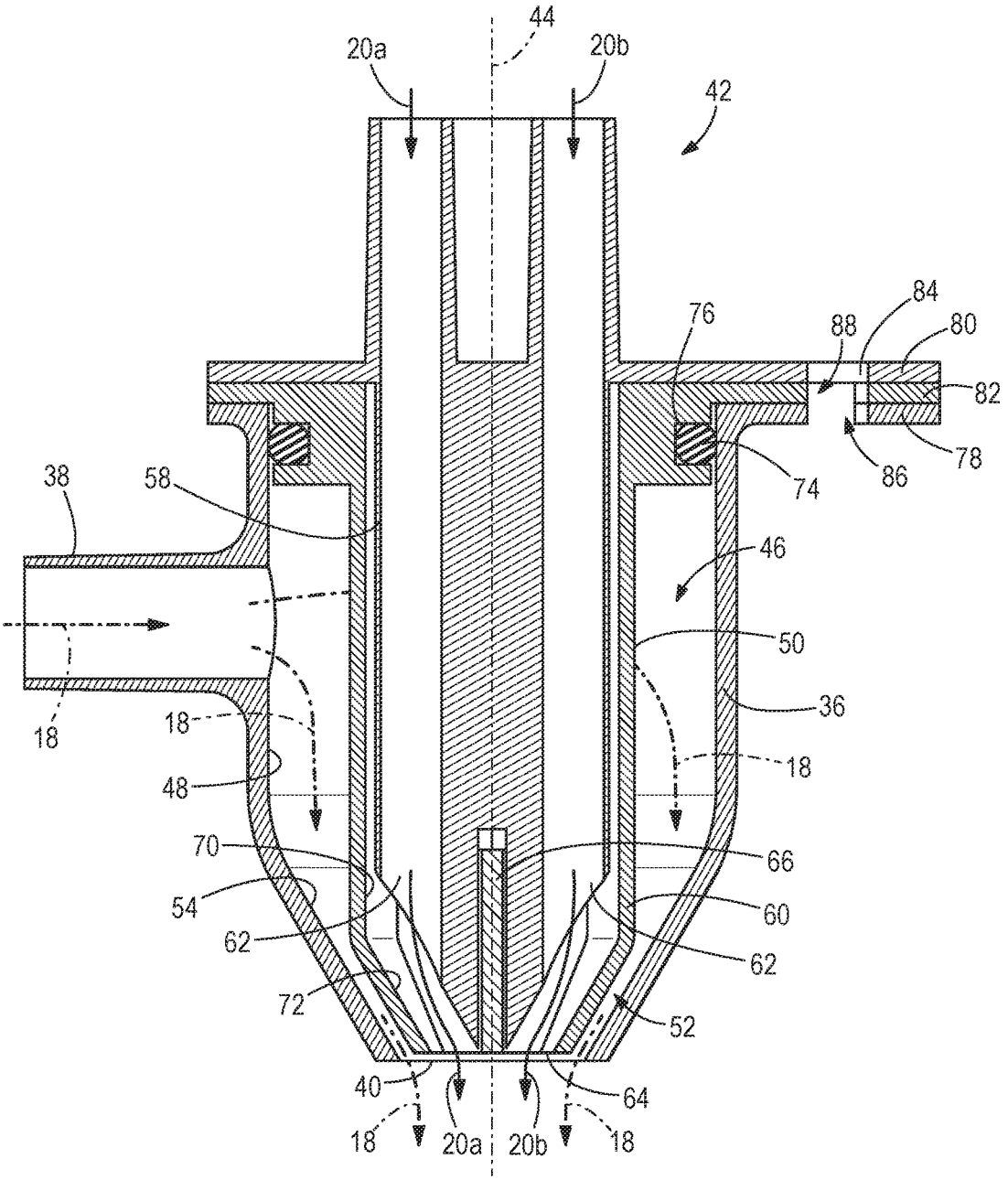
FIG. 6 is a view of Section 6-6 taken in FIG. 4.
Figure 7:
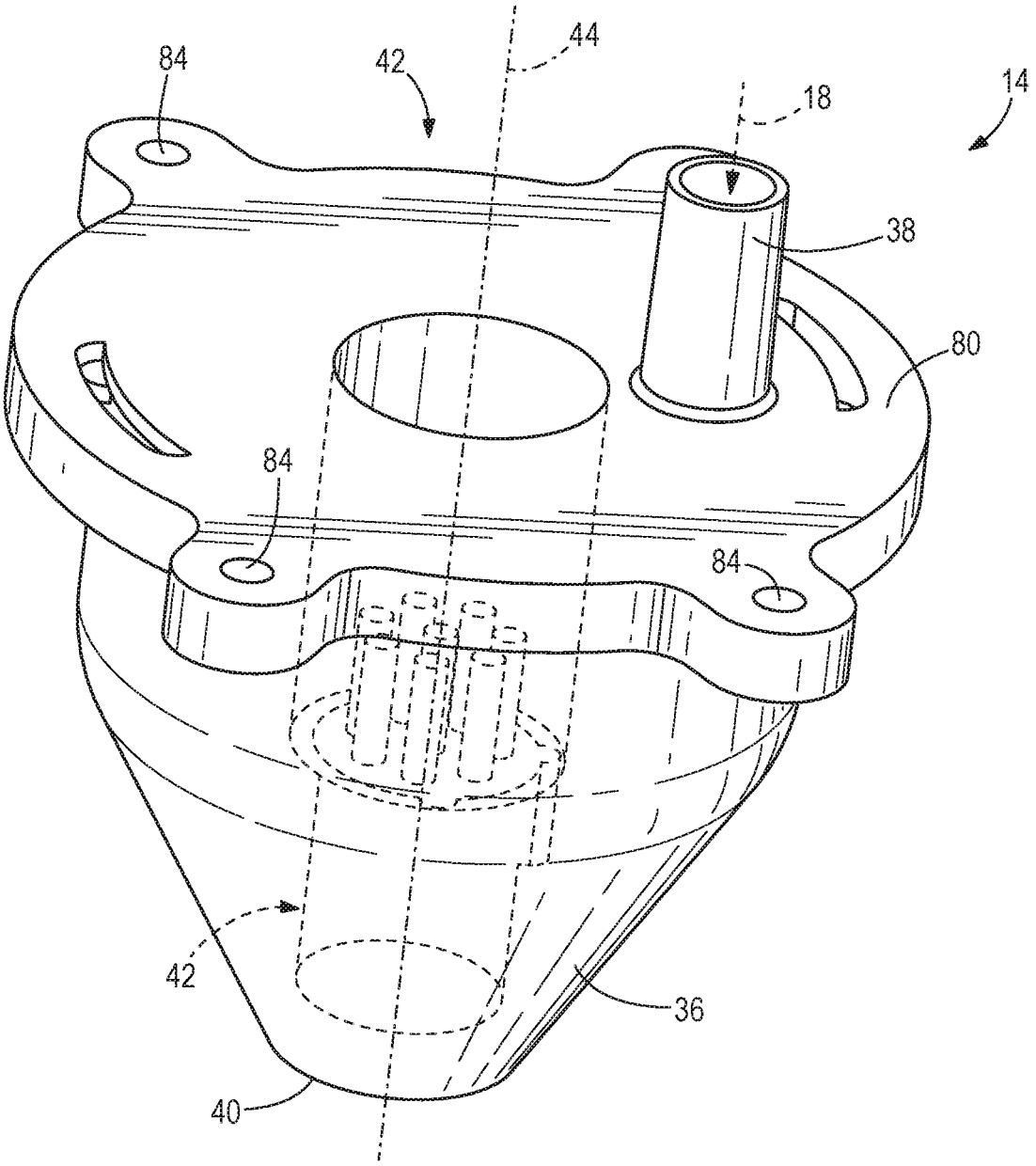
FIG. 7 is a perspective view of another exemplary dispenser apparatus.

The downstream injector body 60 has an inner peripheral surface 70 that is configured to deflect the plurality of additives 20 radially inwardly towards the injector outlet 64. More specifically, the inner peripheral surface 70 has a lower portion 72 that is funnel-shaped for deflecting the plurality of additives 20 radially inwardly towards the injector outlet 64 along the outlet axis 44. As illustrated in FIG. 6, the injector outlet 64 and the downstream outlet 40 of the dispenser body 36 are coaxial along the outlet axis 44.

In the illustrated example, an O-ring 74 is disposed in a seal groove 76 formed around the outer perimeter of an upper portion of the downstream injector body 60. The O-ring 74 provides a fluid-tight seal between the downstream injector body 60 and the inner peripheral surface 48 of the dispenser body 36. The dispenser body 36, upstream injector body 58 and downstream injector body 60 have top flanges 78, 80, 82 configured to stack together such that the top flange 82 of the downstream injector body 60 is sandwiched between the respective top flanges 78, 80 of the dispenser body 36 and upstream injector body 58.

Mounting holes 84 are formed through the top flange 80 of the upstream injector body 58 for mounting the upstream injector body 58 in the dispenser housing 16 with fasteners (not shown) such as a screw and bolt. Open-ended mounting passages 86, 88 are formed in the respected top flanges 78, 80. In this manner, the dispenser body 36 and downstream injector body 60 can be easily removed for maintenance and/or cleaning, without fully removing the noted fasteners.

It will thus be understood by those having ordinary skill in the art that the dispenser apparatus 12 is configured to dispense at least one base condiment 18 and at least one additive 20 together via the downstream outlet 40. In the illustrated example, the dispenser body 36 and the additive injector 42 are configured so that additive(s) 20 are enveloped by and remain partially separated from the base condiment 18 as the base condiment 18 and additive(s) 20 are dispensed via the downstream outlet 40. The dispenser body 36 and the additive injector 42 are configured so that the base condiment 18 is dispensed in a tubular form (i.e. as it travels through the circular cross section of the downstream outlet 40). The tubular form peripherally surrounds the additive(s) 20, which are centrally located within the base condiment 18. Thus, the consumer will see a dispensed product having a single color or consistency—most related to the base condiment 18. Once the dispensed product is contacted by the consumer and/or the consumer's food, the base condiment 18 and additive 20 can be mixed in a swirling action to achieve a visually appealing dispensed product.

Through research and experimentation, the present inventors have found it can be advantageous to convey the base condiment 18 to the downstream outlet 40 at a first velocity and to inject the additive(s) 20 into the base condiment 18 at a second velocity, wherein the first velocity and the second velocity are different. This can be performed by the controller 32 which controls the noted pumps 34 and/or valves 35 associated with the supply of base condiment 18 and supplies of additive(s) 20. In some examples, the differences in the velocities may cause a shear force to be created between the base condiment 18 and the additive(s) 20. The shear force has been found by the inventors to cause the surfaces of the base condiment 18 and the additives 20 to at least partially mix with each other. This helps maintain a more consistent dispense of a consistent product from the dispenser apparatus 12. As stated herein above, it is not essential that the additive body be an injector that injects the additive(s) into the base condiment(s). In other examples, the additive body can be configured to cause the additive(s) and base condiment(s) to concurrently dispense along side of each other.

Figure 4:
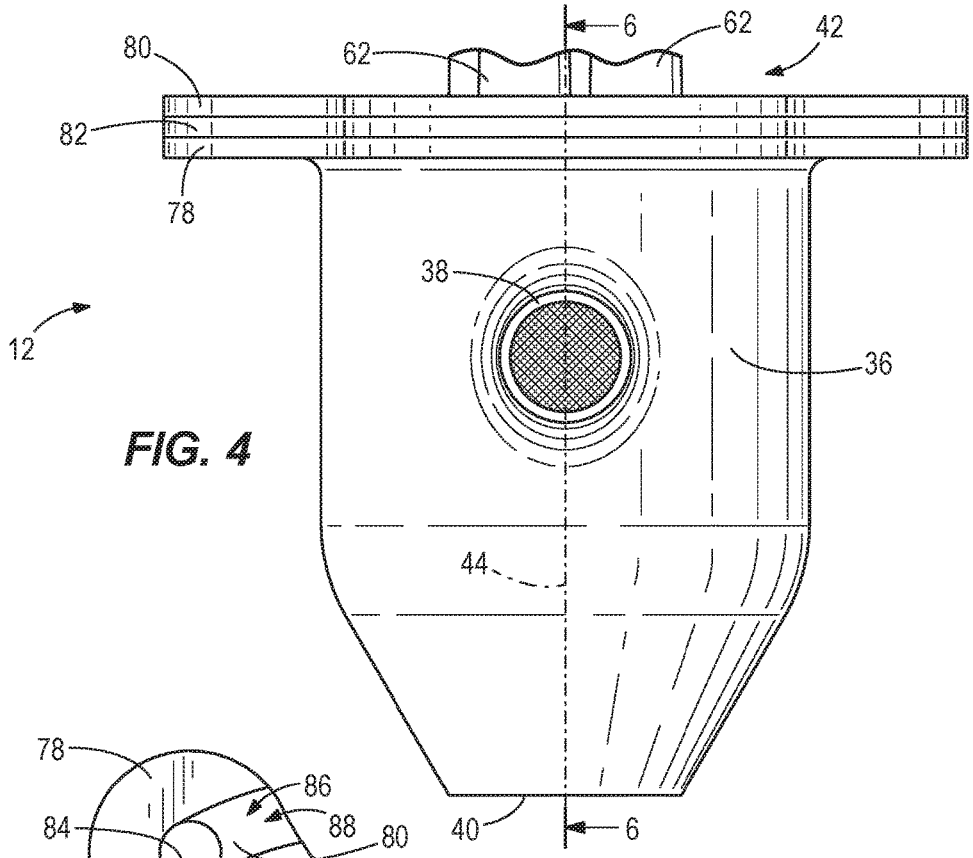
FIG. 4 is a side view of the dispenser apparatus shown in FIG. 2.
Figure 5:
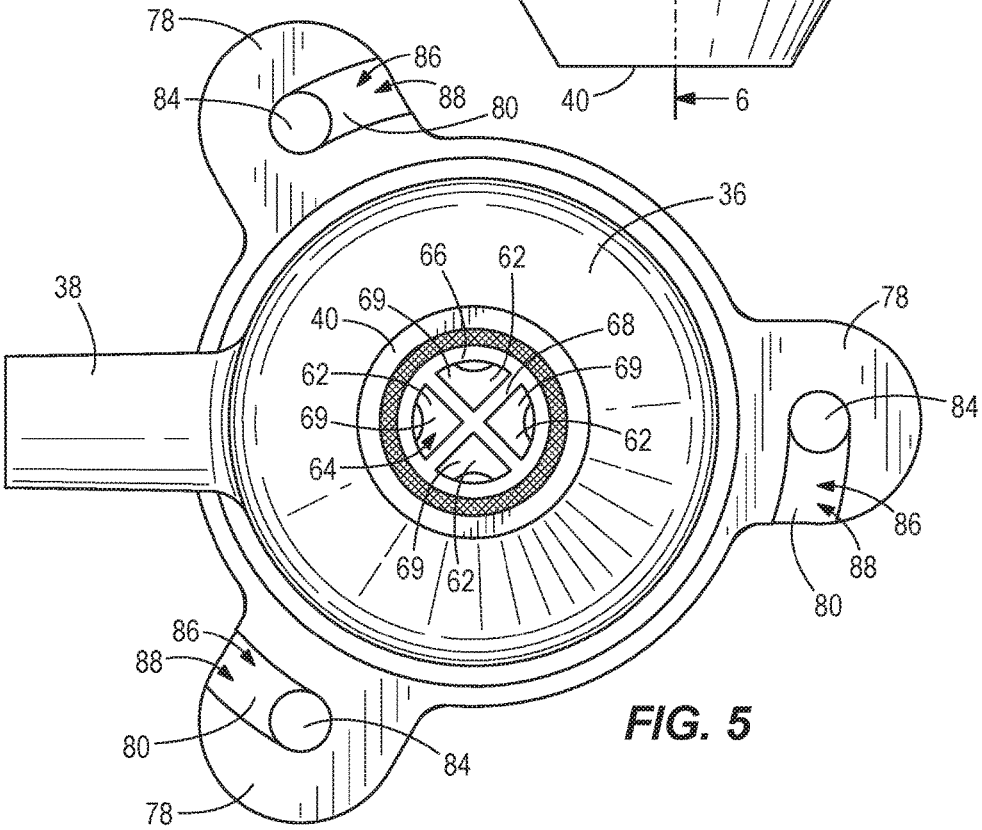
FIG. 5 is a bottom view of the dispenser apparatus shown in FIG. 2.
Figure 9:
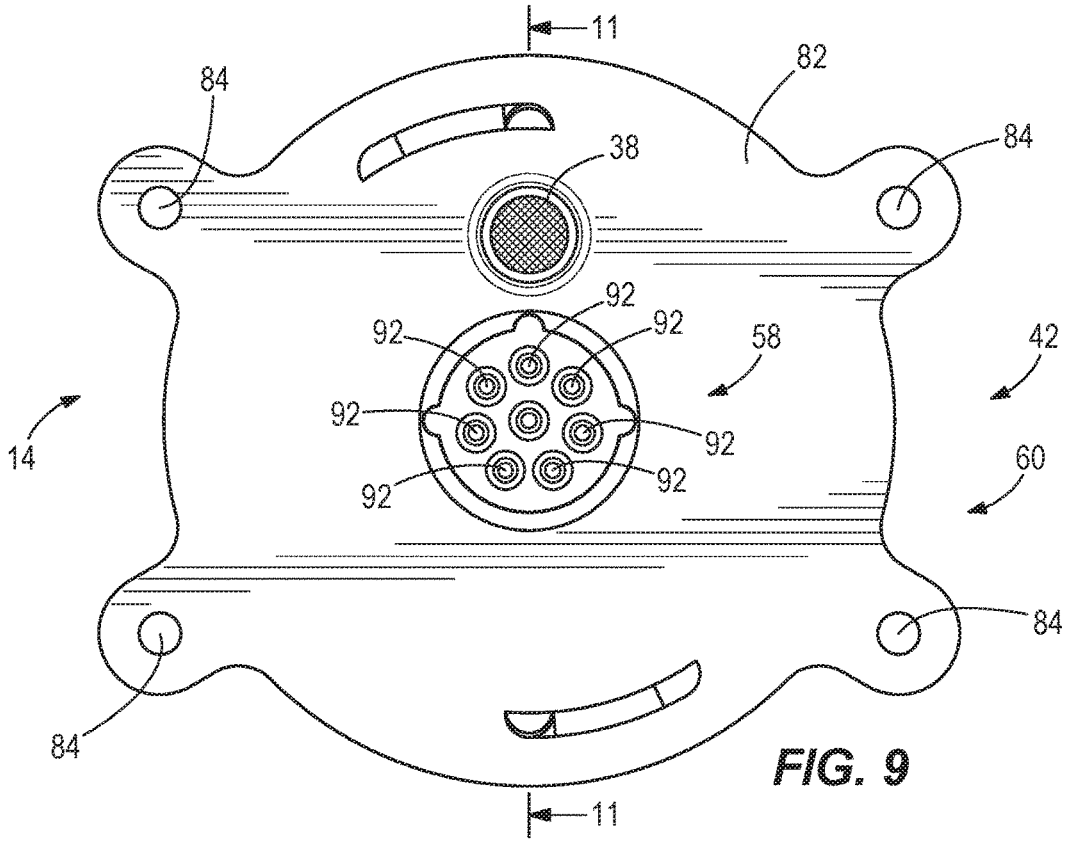
FIG. 9 is a top view of the dispenser apparatus shown in FIG. 7.
Figure 10:
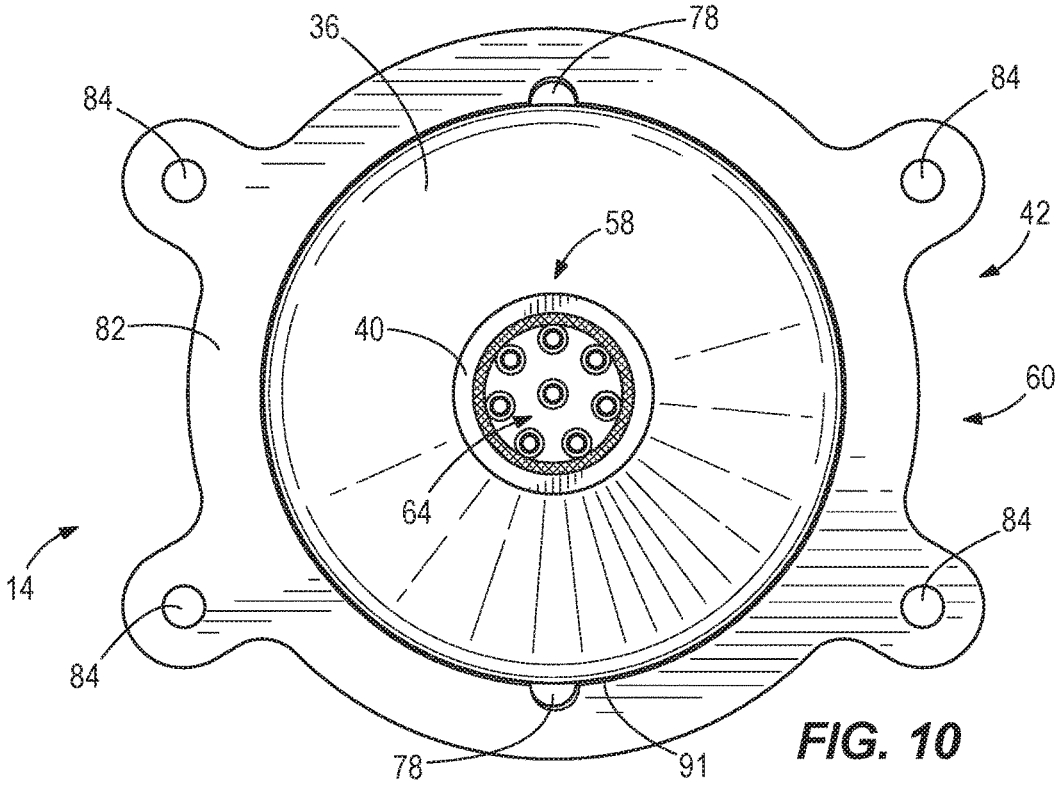
FIG. 10 is a bottom view of the dispenser apparatus shown in FIG. 7.
Figure 11:
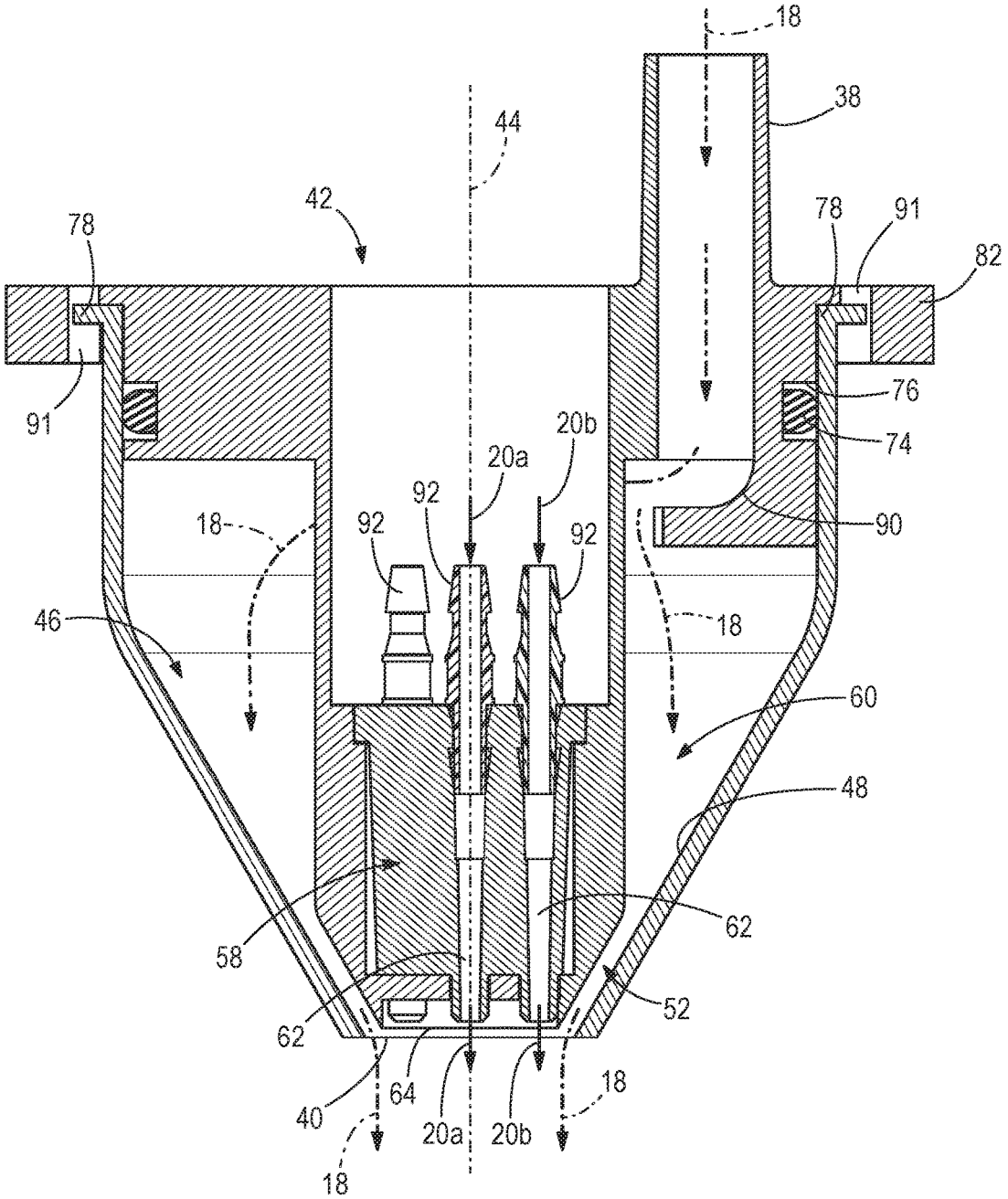
FIG. 11 is a view of Section 11-11 taken in FIG. 9.

Through research and experimentation, the present inventors have also found it to be advantageous to form the upstream inlet 38 with a cross sectional area that is substantially equal to the cross sectional area of the downstream outlet 40 (e.g. see cross-hatch shading on FIGS. 4-5 of dispensing apparatus 12; see cross-hatch shading on FIGS. 9-10 of dispensing apparatus 14). This maintains a consistent pour from the dispenser apparatus 12.

Figure 8:
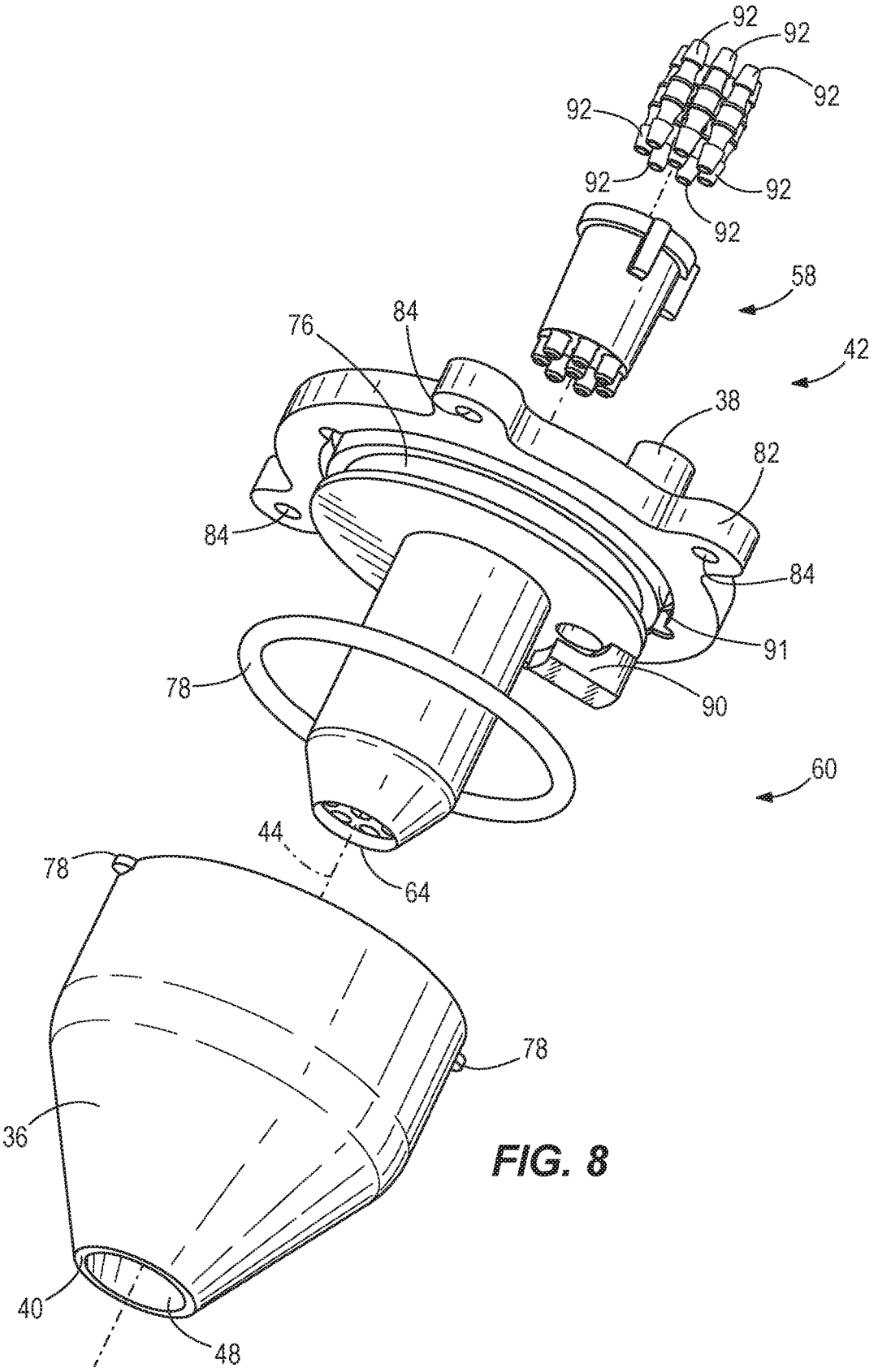
FIG. 8 is an exploded view of the dispenser apparatus shown in FIG. 7.

Referring now to FIGS. 7-11, the second embodiment of the dispenser apparatus 14 includes an upstream inlet 38 that extends parallel to the outlet axis 44. Like reference numbers are applied to refer to features that correspond to features of the embodiment shown in FIGS. 2-6. The dispenser apparatus 14 differs from the dispenser apparatus 12 in that the inner peripheral surface 48 of the dispenser body 36 has a portion that forms a curved baffle 90 that deflects the base condiment 18 radially inwardly from the upstream inlet 38 towards the additive injector 42. The dispenser apparatus 14 also has a differently configured additive injector 42 than that provided in the dispenser apparatus 12. As shown in FIG. 8, the additive injector 42 includes a plurality of barbed connectors 92, each of which being configured to connect to one of the plurality of supply lines 22. The additive injector 42 also does not have a downstream injector body 60 that abuts an inner surface of the upstream injector body 58 such that the additive injector 42 does not have the inner peripheral surface 70 for radially directing the additive 20. Instead, the additive 20 tends to flow straight out of the injector outlet 64, parallel to the outlet axis 44. This arrangement has been found to be effective with additives 20 that are less viscous and/or highly concentrated. The dispenser apparatus 14 also has a differently configured connection between the dispenser body 36 and the additive injector 42. The dispenser body 36 is coupled to the additive injector 42 by positioning the top flange 78 of the dispenser body 36 into an engagement groove 91 of the additive injector 42 and rotating the dispenser body 36. In this manner, the dispenser body 36 can be easily connected to and/or removed from the additive injector 42 for maintenance and/or cleaning.

The present disclosure thus provides systems 10 for dispensing a base condiment 18 and at least one additive 20. The systems 10 can include one or more supplies of base condiment 18 and one or more supplies of a plurality of additives 20*a*-20*d*. A dispenser apparatus 12 is configured to dispense the base condiment 18 and the additive(s) 20 together. The operator input device 26 and the controller 32 are configured to control the system 10 to dispense the base condiment 18 and the additive(s) 20 according to an input from the operator input device 26. The dispenser apparatus 12 has a dispenser body 36 with an upstream inlet 38 configured to receive the base condiment 18 and a downstream outlet 40 configured to dispense the base condiment 18 together with the additive(s) 20. An additive injector 42 is configured to inject the additive(s) 20 into the base condiment 18 as the base condiment 18 is conveyed from the upstream inlet 38 to the downstream outlet 40. The dispenser body 36 and the additive injector 42 are uniquely configured so that the additive(s) 20 remains enveloped by and at least partially separated from the base condiment 18 as the base condiment 18 and the additive(s) 20 are dispensed via the downstream outlet 40. The dispenser body 36 and the additive injector 42 are configured so that the base condiment 18 is dispensed in a tubular form that peripherally surrounds the additive(s) 20. The dispenser body 36 can be configured to convey the base condiment 18 to the downstream outlet 40 at a velocity that is different than a velocity at which the additive injector injects the additive(s) 20 into the base condiment(s) 18, thereby causing a shear force that causes the base condiment 18 and the additive(s) 20 to partially mix with each other on respective surfaces of the additive(s) 20 and base condiment 18.

The present disclosure thus also provides methods for dispensing at least one base condiment 18 and at least one additive 20, including for example selecting a base condiment 18 from a plurality of base condiments 18, selecting an additive 20 from a plurality of additives 20, and supplying the base condiment 18 and the additive 20 to a dispenser apparatus 12 that dispenses the base condiment 18 and the additive 20 together. In certain examples, two or more additives 20 can be selected and supplied with the base condiment 18 to the dispenser apparatus 12 so that the dispenser apparatus 12 dispenses the base condiment 18 and the two or more additives 20 together.

The respective coaxial tubes of base condiment 18 and additive 20 can be dispensed and injected, respectively, concurrently or non-concurrently. The base condiment(s) 18 and/or additive(s) 20 can be dispensed independently of each other. The base condiment(s) 18 and/or the additive(s) 20 can be pressurized or gravity fed. The base condiment(s) 18 and/or the additive(s) 20 can be low- or high-viscosity fluids and have low- or high-concentration flavorings. The dispenser body 36 can be configured such that the base condiment(s) 18 are retained in the dispenser body 36 by surface tension and/or capillary action at the downstream outlet 40 which prevents the base condiment 18 from dispensing until the pressure on the base condiment(s) 18 in the dispenser body 36, for example from upstream pump action or gravity force, overcome the capillary action. Similarly, the additive injector 42 can be configured such that the additive(s) 20 are held in the additive injector 42 by capillary action until the pressure on the additive 20, for example from upstream pump action or gravity force, overcomes the capillary action.

Certain examples of dispenser apparatuses, systems and methods for dispensing condiments, as incorporated herein by reference, can include a static mixer that is disposed downstream of the downstream outlet 40 of the dispenser body 36 and configured to mix the base condiment 18 with the additive(s) 20. In other examples, mixing grooves are coupled to or defined by the inner peripheral surface 48 of the dispenser body 36 to direct the base condiment 18 around the additive injector 42. In other examples, radially projecting fins project from the inner peripheral surface 48 of the dispenser body 36 toward the additive injector 42 to divide the chamber 46 into separate portion configured to receive separate base condiments 18. In certain examples, the dispenser apparatus 12 includes check valves. In certain examples, the injector port 62 is split into two separate paths. In certain examples, a plunger is configured to apply pressure to the base condiment 18 such that the base condiment 18 dispenses. In certain examples, the dispenser body 36 and/or the additive injector 42 comprise hydrophobic materials. In certain examples, the base condiment 18 and/or additives 20 are pressurized with a gas such as ambient air, oxygen, CO2, nitrogen, and/or the like.

What is claimed is:

1. A dispenser apparatus for dispensing a base condiment together with at least one additive, the dispenser apparatus comprising:

a dispenser body having an upstream inlet configured to receive the base condiment and a downstream outlet configured to dispense the base condiment together with the at least one additive; and an additive body configured to supply the at least one additive into the dispenser body as the base condiment is conveyed from the upstream inlet to the downstream outlet such that the base condiment and the at least one additive are concurrently dispensed via the downstream outlet;

wherein the additive body comprises an additive injector having an injector outlet that is configured to inject the at least one additive into the base condiment as the base condiment is conveyed from the upstream inlet to the downstream outlet;

wherein the dispenser body and the additive injector are configured so that the at least one additive is enveloped by and remains at least partially separated from the base condiment as base condiment and at least one additive are dispensed together via the downstream outlet; and wherein the injector outlet and the downstream outlet of the dispenser body are coaxial so that the base condiment is dispensed in a tubular form that peripherally surrounds the at least one additive;

wherein the at least one additive comprises a plurality of additives and wherein the additive injector comprises a plurality of additive injector ports, one additive injector port in the plurality of additive injector ports for each additive in the plurality of additives;

wherein the additive injector comprises an upstream injector body that forms the plurality of injector ports and a downstream injector body that defines the injector outlet configured to discharge the plurality of additives;

a separator located at the injector outlet and configured to maintain at least some separation amongst the additives in the plurality of additives as the plurality of additives is discharged via the injector outlet.

2. The dispenser apparatus according to claim 1, wherein the dispenser body is configured to convey the base condiment to the downstream outlet at a first velocity, wherein the additive injector is configured to inject the at least one additive into the base condiment at a second velocity, and wherein the first velocity and second velocity are different so that a shear force is created between the base condiment and the at least one additive, the shear force being sufficient to cause surfaces of the base condiment and the at least one additive to partially mix with each other.

3. The dispenser apparatus according to claim 1, wherein the upstream inlet has a cross-sectional area and wherein the downstream outlet has a cross-sectional area that is substantially equal to the cross-sectional area of the upstream inlet.

4. The dispenser apparatus according to claim 1, wherein the downstream outlet extends along an outlet axis and wherein the upstream inlet extends transversely to the outlet axis.

5. The dispenser apparatus according to claim 1, wherein the downstream outlet extends along an outlet axis and wherein the upstream inlet extends parallel to the outlet axis.

6. The dispenser apparatus according to claim 1, wherein the dispenser body defines a chamber and wherein the additive injector is disposed in the chamber.

7. The dispenser apparatus according to claim 6, wherein the dispenser body has an inner peripheral surface and wherein the additive injector has an outer peripheral surface that is spaced apart from the inner peripheral surface of the dispenser body, wherein a base condiment passage is defined between the inner peripheral surface of the dispenser body and the outer peripheral surface of the additive injector.

8. The dispenser apparatus according to claim 7, wherein the inner peripheral surface of the dispenser body is configured to deflect the base condiment radially inwardly from the upstream inlet towards the additive injector.

9. The dispenser apparatus according to claim 8, wherein the inner peripheral surface of the dispenser body has a portion that is funnel-shaped for deflecting the base condiment radially inwardly from the upstream inlet towards the additive injector.

10. The dispenser apparatus according to claim 9, wherein the inner peripheral surface of the dispenser body has a portion that forms a curved baffle that deflects the base condiment radially inwardly from the upstream inlet towards the additive injector.

11. The dispenser apparatus according to claim 1, wherein the plurality of injector ports extend parallel to the downstream outlet of the dispenser body.

12. The dispenser apparatus according to claim 1, wherein the upstream injector body is nested in the downstream injector body and wherein the downstream injector body is nested in the dispenser body.

13. The dispenser apparatus according to claim 1, wherein the separator comprises a grate that extends across the injector outlet.

14. The dispenser apparatus according to claim 1, wherein the downstream injector body comprises an inner peripheral surface that is configured to deflect the plurality of additives radially inwardly towards the injector outlet.

15. The dispenser apparatus according to claim 14, wherein the inner peripheral surface of the downstream injector body has a portion that is funnel-shaped for deflecting the plurality of additives radially inwardly towards the injector outlet.

16. A system for dispensing a base condiment together with at least one additive, the system comprising:

a supply of base condiment;

a supply of at least one additive;

a dispenser apparatus comprising a dispenser body having an upstream inlet that is configured to receive the base condiment and a downstream outlet that is configured to dispense the base condiment together with the at least one additive; and an additive body having an additive injector with an injector outlet that is configured to supply the at least one additive into the dispenser body as the base condiment is conveyed from the upstream inlet to the downstream outlet such that the base condiment and the at least one additive are concurrently dispensed from the dispenser apparatus;

wherein the dispenser body and the additive body are configured so that the at least one additive is enveloped by and remains at least partially separated from the base condiment as the base condiment and the at least one additive are dispensed together via the downstream outlet; and wherein the injector outlet and the downstream outlet of the dispenser body are coaxial so that the base condiment is dispensed in a tubular form that peripherally surrounds the at least one additive;

wherein the at least one additive comprises a plurality of additives and wherein the additive injector comprises a plurality of additive injector ports, one additive injector port in the plurality of additive injector ports for each additive in the plurality of additives;

wherein the additive injector comprises an upstream injector body that forms the plurality of injector ports and a downstream injector body that defines the injector outlet configured to discharge the plurality of additives;

a separator located at the injector outlet and configured to maintain at least some separation amongst the additives in the plurality of additives as the plurality of additives is discharged via the injector outlet.

17. The system according to claim 16, further comprising an operator input device and a controller that is configured to control the system so as to dispense the base condiment together with the at least one additive according to an input from the operator input device.

18. The system according to claim 17, wherein the controller is configured to control the system to dispense the base condiment together with one or more selected additives of the plurality of additives based upon the input from the operator input device.

19. The system according to claim 16, wherein the dispenser body is configured to convey the base condiment to the downstream outlet at a first velocity and wherein the additive body is configured to inject the at least one base condiment into the base condiment at a second velocity and wherein the first velocity and second velocity are different so that a shear force is created between the base condiment and the at least one additive, the shear force being sufficient to cause surfaces of the base condiment and the at least one additive to at least partially mix with each other.

* * * * *